US008682220B2

(12) United States Patent
Miyaji

(10) Patent No.: US 8,682,220 B2
(45) Date of Patent: Mar. 25, 2014

(54) IMAGE FORMING APPARATUS CONTROLLING AREAS IRRADIATED BY STATIC ELIMINATION LIGHT

(75) Inventor: Shinki Miyaji, Osaka (JP)

(73) Assignee: Kyocera Document Solutions Inc. (JP)

( * ) Notice: Subject to any disclaimer, the term of this patent is extended or adjusted under 35 U.S.C. 154(b) by 740 days.

(21) Appl. No.: 12/907,344

(22) Filed: Oct. 19, 2010

(65) Prior Publication Data

US 2011/0096452 A1 Apr. 28, 2011

(30) Foreign Application Priority Data

Oct. 23, 2009 (JP) ..... 2009-244647
Feb. 25, 2010 (JP) ..... 2010-039820

(51) Int. Cl.
*G03G 21/00* (2006.01)

(52) U.S. Cl.
USPC ..... 399/128

(58) Field of Classification Search
USPC ..... 399/127, 128, 176
See application file for complete search history.

(56) References Cited

U.S. PATENT DOCUMENTS

| | | | | |
|---|---|---|---|---|
| 6,374,073 | B2 * | 4/2002 | Ozaki et al. | 399/176 X |
| 6,507,719 | B2 * | 1/2003 | Furuya | 399/128 |
| 2006/0188288 | A1 | 8/2006 | Tomiie et al. | |
| 2008/0181666 | A1 * | 7/2008 | Katahira et al. | 399/176 X |

FOREIGN PATENT DOCUMENTS

| | | |
|---|---|---|
| JP | 2001-034129 | 2/2001 |
| JP | 2003-248400 | 9/2003 |
| JP | 2006-234882 | 9/2006 |
| JP | 2008-052207 | 3/2008 |
| JP | 2008-139514 | 6/2008 |

* cited by examiner

*Primary Examiner* — Sandra Brase
(74) *Attorney, Agent, or Firm* — Ostrolenk Faber LLP

(57) ABSTRACT

An image forming apparatus (1) forms a toner image by using toner which includes external additives to develop a latent image which is formed via charging and exposure on a surface of a photosensitive drum (18), and transfers the toner image onto a transfer material, and includes: a static elimination unit (19) that irradiates static elimination light onto the surface of the photosensitive drum before the surface of the photosensitive drum is charged, and removes any charge remaining on the surface of the photosensitive drum after it has completed the transfer; and a static elimination intensity adjustment device (74) that, compared with inner side areas of the paper feed width, lessens the amount of static elimination light irradiated onto areas which, when viewed in the direction of the rotation axis of the photosensitive drum, are on an outer side of the paper feed width and are also on an inner side of the developing width.

12 Claims, 11 Drawing Sheets

IMAGE FORMING APPARATUS CONTROLLING AREAS IRRADIATED BY STATIC ELIMINATION LIGHT

BACKGROUND OF THE INVENTION

1. Field of the Invention

The present invention relates to an image forming apparatus that outputs a toner image on a photosensitive drum onto an intermediate transfer medium or copy paper.

Priority is claimed on Japanese Patent Application No. 2009-244647, filed Oct. 23, 2009, and Japanese Patent Application No. 2010-039820, filed Feb. 25, 2010, the content of which is incorporated herein by reference.

2. Description of Related Art

In this type of image forming apparatus electrophotography is used. A charging unit preliminarily charges a photosensitive drum, and when an exposure section irradiates light onto the surface of the photosensitive drum, an electrostatic latent image is formed on this photosensitive drum surface. A developer supports a toner, and when a developing bias voltage is applied thereto, the toner becomes excited to adhere to the electrostatic latent image and a toner image is formed (i.e., developed) on the surface of the photosensitive drum. The visibilized toner image is then either transferred onto copy paper or is transferred onto copy paper via an intermediate transfer medium and is then fixed.

Here, a structure that irradiates static elimination light onto the surface of the photosensitive drum is known. This is because a memory image is generated unless the exposure history of the photosensitive drum is deleted. Therefore, a static elimination unit irradiates static elimination light before the surface of the photosensitive drum is charged, and thereby removes any charge (i.e., residual charge) remaining on the surface of the photosensitive drum after a transfer.

Note that there are cases when a minute amount of toner is not transferred onto the copy paper but remains on the surface of the photosensitive drum. This toner must be removed before the next image formation. Because of this, cleaning the surface of this photosensitive drum using a cleaning blade is also disclosed.

On the surface of a photosensitive drum, areas on the outer side of the paper feed width as seen from the direction of the axis of rotation of this photosensitive drum form a range where an image is not formed. This is because the transfer surface of the intermediate transfer medium does not come into contact here with the copy paper. In order to make it possible to also form a toner image at both the left and right ends of a sheet of copy paper, it is necessary to set the developing width wider than the paper feed width. In addition, the charging width is set wider than the developing width. This is because, if the charging width were to be narrower than the developing width, toner would continuously adhere to the outer side areas of this charging width.

Namely, by applying a developing bias voltage, toner (including external additives) is made to travel towards areas located on the outer side of the paper feed width which are also on the inner side of the developing width. However, because these areas correspond to the areas on the inner side of the charging width, the toner itself does not adhere to the surface of the photosensitive drum, but instead returns to the developer. In contrast to this, the external additives themselves become separated from the toner and are left behind on the relevant areas. Thereafter, these external additives alone are transferred from the surface of the photosensitive drum onto the transfer surface of the intermediate transfer medium, and become accumulated on the edge of the cleaning blade.

Here, a state in which only external additives have been transferred onto the transverse surface of the former is one that it is difficult for the cleaning apparatus of the intermediate transfer medium to clean. In addition, although only slight, the difference in linear velocity between the intermediate transfer medium and the photosensitive drum is an additional factor in causing the aforementioned areas of the surface of the photosensitive drum with which this intermediate transfer medium comes into contact which are located on the outer side of the paper feed width and are also located on the inner side of the developing width to become abraded by the external additives. Moreover, a state in which the external additives have been transferred onto the cleaning blade of the latter is one that these areas are abraded by the external additives via the cleaning blade, thus the problem arises that the amount of wear on the photosensitive drum in these areas shortens the lifespan of the photosensitive drum.

Further, in a photosensitive drum which is made of, for example organic materials and thus is comparatively easily abraded, if it makes direct contact with a contact-charging type charging roller, adjacent edge portions of this charging roller deteriorate easily due to electrical discharge.

Specifically, if the shape of a charging roller is formed as a simple circular-cylinder shape with sharply outstanding edges, then the pressing force from the charging roller onto the photosensitive drum surface becomes concentrated in the edge portions of the charging roller, so that distortion is generated which causes areas slightly on the inward side of these edge portions to separate from the photosensitive drum surface.

In addition, in this manner, the pressing force becomes concentrated in the edge portions of the charging roller, the current flowing from the edge portions to the photosensitive drum surface increases compared to that to areas on the inner side of the paper feed width and the deterioration of the surface of the photosensitive drum which is caused by the amount of electrical discharge (i.e., the electrical discharge energy) during charging accelerates. In particular, an excessive electrical discharge phenomenon occurs in areas somewhat on the inner side of these edge portions so that there is marked acceleration in the deterioration of the photosensitive drum surface which is caused by electrical discharge energy, and the problem arises that the deterioration of the photosensitive drum in these areas ends up causing the lifespan of the photosensitive drum to be shortened.

In order to solve this problem, even if the above described conventional technology is utilized, the only effect is that the amount of static elimination light irradiated onto the outer side areas of the paper feed width is increased compared with that onto the inner side areas of the paper feed width. Consequently, the amount of electrical discharge during charging increases resulting in a deterioration of the photosensitive drum surface, and the wear of the outer side areas of the paper feed width is further accelerated.

SUMMARY OF THE INVENTION

Therefore, some aspects of the present invention provide an image forming apparatus that makes it possible to limit the wear of outer side areas of the paper feed width of a photosensitive drum.

A first aspect of the present invention is an image forming apparatus that forms a toner image by using toner which includes external additives to develop a latent image which is formed via charging and exposure on the surface of a photosensitive drum, and that transfers this toner image onto a transfer material.

This image forming apparatus can include: a static elimination unit that irradiates static elimination light onto the surface of the photosensitive drum before the surface of the photosensitive drum is charged, and removes any charge remaining on the surface of this photosensitive drum after it has completed the transfer; and a static elimination intensity adjustment device that, compared with inner side areas of the paper feed width, lessens the amount of static elimination light irradiated onto areas which, when viewed in the direction of the rotation axis of the photosensitive drum, are on the outer side of the paper feed width and are also on the inner side of the developing width.

According to the first aspect of the present invention, a toner image is formed on the surface of a photosensitive drum by developing a latent image thereof using toner by driving the photosensitive drum, and this toner image is then transferred onto a transfer material.

The static elimination unit irradiates static elimination light on the surface of the photosensitive drum prior to charging, and removes any charge (residual charge) remaining on the surface of the photosensitive drum after the transfer.

Here, an example in which an intermediate transfer belt is used for the transfer material will be described. Firstly, because both the toner and external additives in the inner side areas of the paper feed width undergo secondary transfer onto copy paper, there is no residue of these on the transfer surface of the transfer belt. Moreover, even if developing bias voltage is applied thereto, the toner in the areas on the outer side of the paper feed width which are also on the inner side of the developing width does not itself become adhered to the surface of the photosensitive drum. In contrast, the external additives themselves separate from the toner and remain in these areas, and only these external additives are transferred from the surface of the photosensitive drum onto the transfer surface of the transfer belt. This phenomenon can also be ascertained from the fact that a white band appears on the transfer surface extending in the circumferential direction thereof.

The locations that appear as this white band have a higher abrasion capability and the areas on the outer side of the paper feed width which are also the inner side of the developing width are more abraded than the areas on the inner side of the paper feed width.

However, according to the present aspect, the static elimination intensity adjustment devices lessen the amount of static elimination light irradiated onto the areas of the surface of the photosensitive drum which are located on the outer side of the paper feed width and which are also on the inner side of the developing width compared to the amount of static elimination light irradiated onto the areas on the inner side of the paper feed width, so that the surface potential in the areas on the outer side of the paper feed width which are also on the inner side of the developing width is higher than the surface potential of the areas on the inner side of the paper feed width.

Namely, in the areas on the outer side of the paper feed width which are also on the inner side of the developing width, there is a decrease in the current flowing from the charging unit to the photosensitive drum when the surface potential is being raised to the level required for the next image formation, and the amount of electrical discharge (i.e., the electrical discharge energy) during charging can be less than in the areas on the inner side of the paper feed width. Accordingly, as a result of any deterioration in the surface of the photosensitive drum which is caused by this electrical discharge energy being suppressed, it becomes difficult for the surface of the photosensitive drum to become abraded by the external additives, and it is possible to achieve a lengthening of the lifespan of the photosensitive drum.

In the first aspect, the static elimination unit can irradiate the static elimination light onto areas which are on the outer side of the paper feed width and are also on the inner side of the developing width.

In this case, in addition to the abovementioned effects, the static elimination unit does not irradiate no static elimination light onto the areas of the surface of the photosensitive drum which are located on the outer side of the paper feed width and which are also on the inner side of the developing width, but instead irradiates a less amount of light compared with the amount of light irradiated onto the areas located on the inner side of the paper feed width. Accordingly, the amount of light required for the areas on the inner side of the paper feed width can be secured, and there is no deterioration in the image quality.

Moreover, if no static elimination light is irradiated, there is a concern that opposite charged toner will be developed, however, as is described above, because the irradiation is performed with the amount of light being kept low, the surface potential in the relevant areas does not become excessively high and it is also possible to prevent internal contamination by developing an opposite charged toner.

Furthermore, because the locations where the amount of static elimination light is lessened are areas on the outer side of the paper feed width, there is no concern of memory image occurring.

In the first aspect, a charging unit that comes into contact with and charges the surface of the photosensitive drum can be further provided.

In this case, in addition to the abovementioned effects, because a contact-charging type charging unit does not generate ozone or nitrogen oxides compared to when a corona discharge type charging unit is used, it is possible to obtain an improvement in image quality, but voltage is also applied to the locations on the surface of the photosensitive drum which have been abraded by the external additives with coming into direct contact. Namely, in these locations, because it is unable to withstand the voltage, leaks are generated that penetrate the photosensitive film, and current escapes in an outward direction so that center portions of the surface are not charged, and image abnormalities such as horizontal black stripes tend to occur. However, if the above described static elimination intensity adjustment device is provided, the aforementioned leaks can be avoided even if a contact-charging type charging unit is used.

In the first aspect, the photosensitive drum can be a photosensitive drum having an organic-based photosensitive layer on the surface thereof.

In this case, in addition to the abovementioned effects, the surface of a photosensitive drum having an organic-based photosensitive layer is particularly easy to abrade, and there is a concern that abrasion by external additives will have a considerable influence on this photosensitive drum, however, if the above described static elimination intensity adjustment device is provided, the characteristics of this photosensitive drum can be maintained over an extended period and particularly remarkable effects are demonstrated.

In the first aspect, the static elimination intensity adjustment device can be a light shielding member that covers the static elimination unit for the areas which are on the outer side of the paper feed width and are also on the inner side of the developing width.

In this case, in addition to the abovementioned effects, the light shielding member lessens the amount of static elimination light reaching the areas of the surface of the photosensitive drum which are located on the outer side of the paper feed width and which are also on the inner side of the developing width thereby shielding, and making it possible to reliably reduce the generation of electrical discharge energy.

In the first aspect, the static elimination unit is provided with a plurality of light sources having substantially the same light emission characteristics that extend along the rotation axis of the photosensitive drum, and in the static elimination intensity adjustment device, the interval between the light sources which is responsible for the areas which are on the outer side of the paper feed width and are also on the inner side of the developing width can be longer than that of the areas on the inner side of the paper feed width.

In this case, in addition to the abovementioned effects, the intervals between the light sources which are responsible for the areas of the surface of the photosensitive drum which are located on the outer side of the paper feed width and which are also on the inner side of the developing width are widened, and the number of light sources per unit area for the photosensitive drum is reduced so that the amount of static elimination light reaching these areas is lessened. In this case as well, it is possible to reliably reduce the generation of electrical discharge energy.

In the first aspect, the static elimination unit is provided with a plurality of light sources that extend along the rotation axis of the photosensitive drum, and in the static elimination intensity adjustment device, the light emission characteristic of the light sources which is responsible for the areas which are on the outer side of the paper feed width and are also on the inner side of the developing width can be less than that of the areas on the inner side of the paper feed width.

In this case, in addition to the abovementioned effects, the light emission characteristics of the light sources which are responsible for the areas of the surface of the photosensitive drum which are located on the outer side of the paper feed width and which are also on the inner side of the developing width are decreased, and the amount of light under given the same current is reduced so that the amount of static elimination light reaching these areas is lessened. In this case as well, it is possible to reliably reduce the generation of electrical discharge energy.

A second aspect of the present invention is an image forming apparatus that forms a toner image by using toner to develop a latent image which is formed via charging and exposure on a surface of a photosensitive drum, and that transfers this toner image onto a transfer material, and that includes: a charging unit having a charging roller that charges the surface of the photosensitive drum by coming into contact with this surface; and a static elimination unit that irradiates static elimination light onto the surface of the photosensitive drum before the charging is performed, and removes any charge remaining on the surface of this photosensitive drum after it has completed the transfer, wherein the charging roller is shaped such that the areas thereof on the outer side of the developing width when viewed in the direction of the rotation axis of the photosensitive drum become gradually narrower in diameter further from the paper feed width, and the static elimination unit has a static elimination intensity adjustment device that lessens the amount of static elimination light irradiated onto the areas which are on the outer side of the paper feed width compared with the areas which are on the inner side of this paper feed width.

According to the second aspect of the present invention, a toner image is formed on the surface of a photosensitive drum by developing a latent image thereof using toner by driving the photosensitive drum to rotate, and this toner image is then transferred onto a transfer material.

In a contact-charging type charging unit, the charging roller presses against the surface of the photosensitive drum in order to charge it, and because it does not generate ozone or nitrogen oxides compared to when a corona discharge type charging unit is used, it is possible to obtain an improvement in image quality.

Moreover, the static elimination unit irradiates static elimination light onto the surface of the photosensitive drum before the surface of the photosensitive drum is charged, and removes any charge (i.e., residual charge) remaining on the surface of the photosensitive drum after the transfer.

Here, if the voltage from the charging roller is applied by means of direct contact with the surface of the photosensitive drum, the lifespan of the photosensitive drum is shortened. The reason for this is that, in a nip portion between the charging roller and the photosensitive drum, particularly in an edge portion of the charging roller, current flowing from the charging roller to the photosensitive drum increases in comparison with the case of using a corona-discharge type charging roller, and deterioration of the surface of the photosensitive drum because of electrical discharge (electrical discharge energy) during charging is accelerated.

However, according to the present aspect, in the charging roller, areas located on the outer side of the developing width as viewed from the direction of the rotation axis of the photosensitive drum are shaped such that the diameter thereof gradually contracts as it moves away from the paper feed width, and end portions of the charging roller that correspond to these outer side areas of the developing width have contact end portions that are in contact with the surface of the photosensitive drum, and contracted diameter end portions which are difficult to come into contact with the surface of the photosensitive drum even when the charging roller is pressing the photosensitive drum. Accordingly, the stress concentration in edge portions of a conventional charging roller, as well as the distortion on the inner side of these edge portions which is generated from this stress concentration are alleviated.

As a result of this, in end portions of a charging roller, any excessive current flowing into the photosensitive drum is decreased, and it is possible to suppress any deterioration of the surface of the photosensitive drum which is caused by the amount of electrical discharge (i.e., electrical discharge energy) during charging.

At the same time, in the static elimination unit, because the amount of static elimination light irradiated onto the areas of the surface of the photosensitive drum which are located on the outer side of the paper feed width is less compared to areas on the inner side of this paper feed width, in these areas on the outer side of the paper feed width only a small amount of current flowing from the charging unit to the photosensitive drum is needed when the surface potential is being raised to the level required for the next image formation. Because of this, any deterioration in the surface of the photosensitive drum which is caused by the generation of this electrical discharge energy is restricted.

As a result of these, it is possible to suppress wear on the photosensitive drum compared with the conventional technology, and it is possible to achieve a lengthening of the lifespan of the photosensitive drum.

In second aspect, the static elimination unit can irradiate static elimination light onto the areas on the outer side of the paper feed width.

In this case, in addition to the abovementioned effects, the static elimination unit does not irradiate no static elimination light onto the areas of the surface of the photosensitive drum which are located on the outer side of the paper feed width, but instead irradiates a less amount of light compared with the amount of light irradiated onto the areas located on the inner side of the paper feed width. Accordingly, the amount of light required for the areas on the inner side of the paper feed width can be secured, and there is no deterioration in the image quality.

Moreover, if no static elimination light is irradiated, there is a concern that opposite charged toner will be developed, however, as is described above, because the irradiation is performed with the amount of light being kept low, the surface potential in the relevant areas does not become excessively high and it is also possible to prevent internal contamination by developing an opposite charged toner. Furthermore, because the locations where the amount of static elimination light is lessened are areas on the outer side of the paper feed width, there is no concern of memory image occurring.

In second aspect, the photosensitive drum can be a photosensitive drum having an organic-based photosensitive layer on the surface thereof.

In this case, in addition to the abovementioned effects, the surface of a photosensitive drum having an organic-based photosensitive layer is particularly easy to abrade, and there is a concern that deterioration caused by electrical discharge will have a considerable influence on this photosensitive drum, however, if the above described charging roller shape is used in combination with the control of the amount of light from the static elimination unit, the characteristics of this photosensitive drum can be maintained over an extended period and particularly remarkable effects are demonstrated.

In second aspect, the toner image can be formed by developing using toner containing external additives.

In this case, in addition to the abovementioned effects, if there is any advance in the deterioration of the surface of the photosensitive drum, then the surface of the photosensitive drum is easily abraded by the contact member which is in contact with the surface of the photosensitive drum. However, if the above described charging roller shape is used in combination with the control of the amount of light from the static elimination unit, the stress concentration in edge portions of a charging roller, as well as distortion are alleviated. In addition, the amount of static elimination light irradiated outside the toner image formation range is lessened, and deterioration of the surface of the photosensitive drum is inhibited. Moreover, it is possible, in addition to limiting wear on the surface of the photosensitive drum which is caused by generating of the aforementioned electrical discharge energy, to also achieve a limiting of wear on the surface of the photosensitive drum which is caused by abrasion from external additives.

In the second aspect, the static elimination intensity adjustment device can be a light shielding member that covers the static elimination unit for the areas which are on the outer side of the paper feed width and are also on the inner side of the developing width.

In this case, in addition to the abovementioned effects, the light shielding member lessens the amount of static elimination light reaching the areas of the surface of the photosensitive drum which are located on the outer side of the paper feed width and which are also on the inner side of the developing width thereby shielding, and making it possible to reliably reduce the generation of electrical discharge energy.

In the second aspect, the static elimination unit is provided with a plurality of light sources having substantially the same light emission characteristics that extend along the rotation axis of the photosensitive drum, and in the static elimination intensity adjustment device, the interval between the light sources which is responsible for the areas which are on the outer side of the paper feed width and are also on the inner side of the developing width can be longer than that of the areas on the inner side of the paper feed width.

In this case, in addition to the abovementioned effects, the intervals between the light sources which are responsible for the areas of the surface of the photosensitive drum which are located on the outer side of the paper feed width and which are also on the inner side of the developing width are widened, and the number of light sources per unit area for the photosensitive drum is reduced so that the amount of static elimination light reaching these areas is lessened. In this case as well, it is possible to reliably reduce the generation of electrical discharge energy.

In the second aspect, the static elimination unit is provided with a plurality of light sources that extend along the rotation axis of the photosensitive drum, and in the static elimination intensity adjustment device, the light emission characteristic of the light sources which is responsible for the areas which are on the outer side of the paper feed width and are also on the inner side of the developing width can be less than that of the areas on the inner side of the paper feed width.

In this case, in addition to the abovementioned effects, the light emission characteristics of the light sources which are responsible for the areas of the surface of the photosensitive drum which are located on the outer side of the paper feed width and which are also on the inner side of the developing width are decreased, and the amount of light under given the same current is reduced so that the amount of static elimination light reaching these areas is lessened. In this case as well, it is possible to reliably reduce the generation of electrical discharge energy.

According to the present aspects of the present invention, it is possible to provide an image forming apparatus in which, because the amount of static elimination light irradiated onto areas which are on the outer side of the paper feed width and are also on the inner side of the developing width is lessened, excessive wear on the photosensitive drum in these areas can be prevented.

DETAILED DESCRIPTION OF THE INVENTION

An embodiment of the present invention will now be described based on the drawings.

Figure 1:
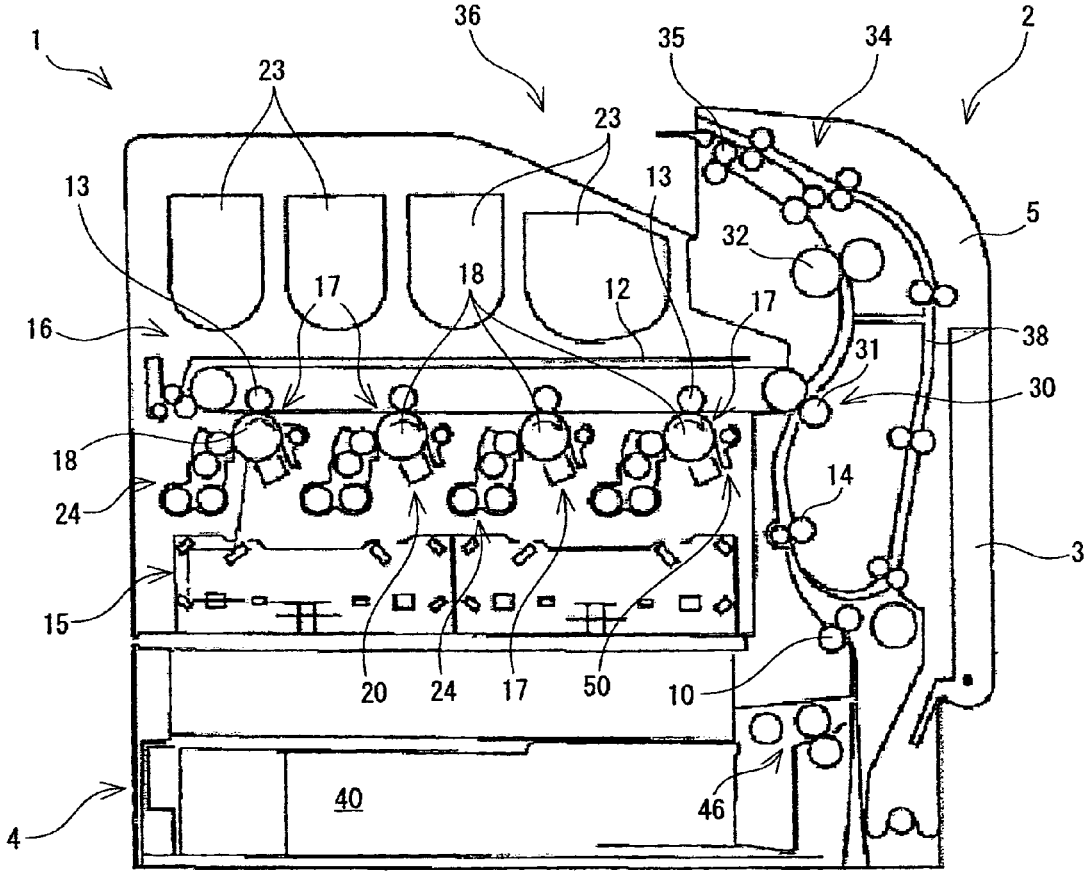
FIG. 1 is a schematic structural view showing a printer of the present example.

In FIG. 1, the structure of a printer 1 which is capable of color printing is shown schematically as an example of an image forming apparatus. The cross-section shown in this drawing is one viewed from the left side surface of the printer 1. Accordingly, the front surface of the printer 1 is located on the right side in FIG. 1, while the rear surface thereof is located on the left side.

As is shown in FIG. 1, a paper output tray 36 is provided above an apparatus main body 2 of the printer 1, and a front cover 5 in which a plurality of operating keys that are supplied for various operations performed by a user as well as a screen that displays a variety of information are arranged, are provided adjacent to this paper output tray 36.

In addition, a paper feed cassette 4 is located below the apparatus main body 2, and sheets of copy paper are housed in a stack in a housing portion 40 thereof. As is shown in FIG. 1, paper feed rollers 46 are provided above and to the right of the housing portion 40.

In FIG. 1, copy paper is conveyed upwards and to the right from the paper feed cassette 4, and this conveyed copy paper is conveyed upwards along the front surface of the printer 1 inside the apparatus main body 2.

The paper feed cassette 4 is structured such that it can be withdrawn from the front surface side of the printer 1, namely, towards the right in FIG. 1, and while it is withdrawn, new copy paper can be loaded in the housing portion 40, or the copy paper may be replaced with a different type of copy paper.

Conveying rollers 10, register rollers 14, an image formation section 16, and a secondary transfer section 30 are placed in this sequence on the downstream side in the copy paper feed direction from the paper feed cassette 4 inside the apparatus main body 2.

Figure 2:
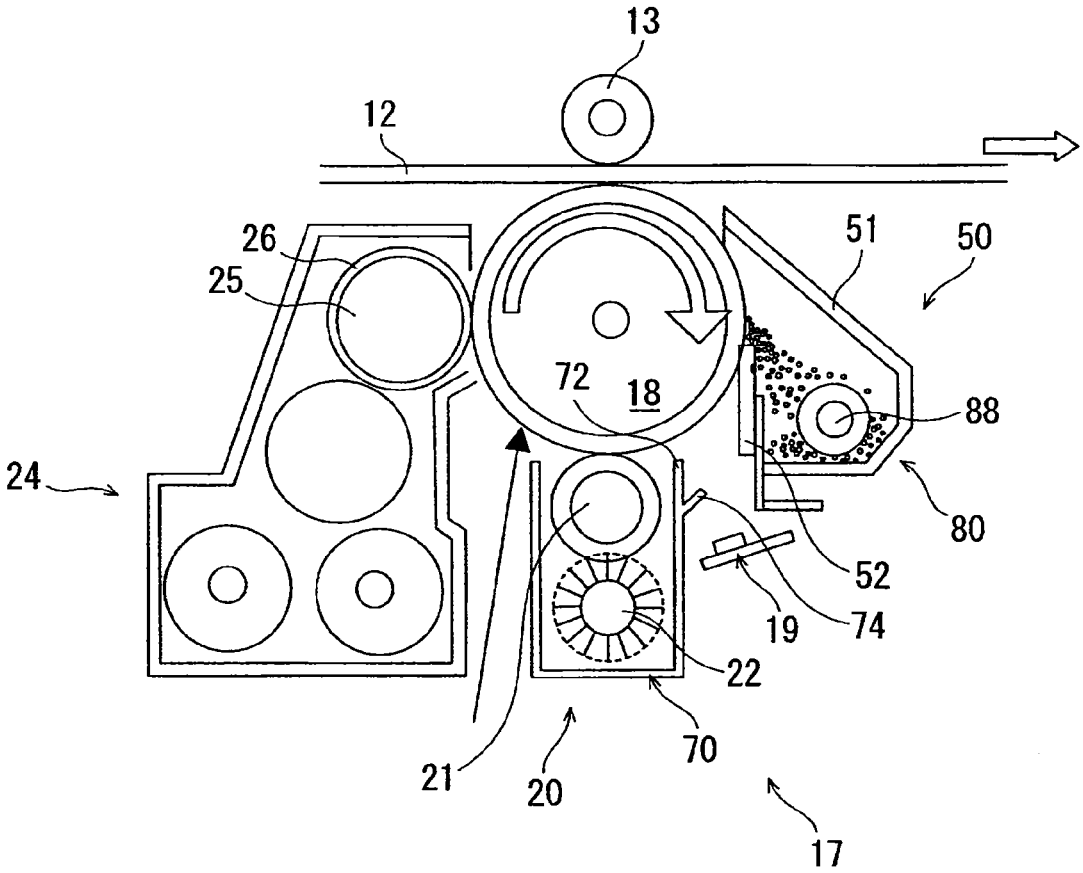
FIG. 2 is a cross-sectional view showing the periphery of the image formation unit shown in FIG. 1.

Four image formation units 17 are placed in parallel in the image formation section 16, and photosensitive drums 18 are provided respectively in each one of the image formation units 17 (see FIG. 1 and FIG. 2). These photosensitive drums 18 are rotatably installed, and are each driven in a clockwise direction in FIG. 1 and FIG. 2 by drive motors (not shown).

The photosensitive drums 18 of the present example are formed having a diameter of, for example, ϕ30 mm, and are single layer OPC (Organic Photoconductor) drums which have an organic-based photosensitive layer on the surface thereof.

Moreover, an exposure section 15 (see FIG. 1) is provided between the photosensitive drums 18 and the paper feed cassette 4, and laser light is irradiated from this exposure section 15 towards each of the photosensitive drums 18. In addition, as is shown in FIG. 1 and FIG. 2, a charging unit 20, a developer 24, an intermediate transfer roller 13, a cleaning portion 50, and an eraser (i.e., a static elimination (charge neutralization) unit) 19 are each provided at suitable positions around each photosensitive drum 18.

As is also shown in FIG. 2, the charging unit 20 is positioned in a bottom portion of each image formation unit 17. The charging unit 20 has a charging roller 21 which is in contact with the photosensitive drum 18, and a sliding friction roller 22 which is provided with brushes which clean the surface of the charging roller 21 by means of abrasive rubbing inside a casing 70 having an open top portion, and the charging unit 20 charges the surface of the photosensitive drum 18. Note that the charging roller 21 is made, for example, from epichlorohydrin rubber, and is formed having a diameter of ϕ12 mm.

Moreover, the developer 24 is located on the left side of the image formation units 17 in FIG. 1 and FIG. 2, and has a developing roller 25 which faces the photosensitive drum 18. This developing roller 25 is driven in an anti-clockwise direction in FIG. 2 by a drive motor (not shown).

Note that the reference symbol 26 in FIG. 2 indicates a gap regulating roller. A gap regulating roller 26 is provided at both ends of the developing roller 25 (see FIG. 3), and they rotate in conjunction with the photosensitive drum 18 so as to set a gap between the developing roller 25 and the photosensitive drum 18.

The image formation section 16 has a rubber intermediate transfer belt (i.e., transfer material) 12, and this intermediate transfer belt 12 is located above the respective photosensitive drums 18. Four toner containers 23 are placed between the intermediate transfer belt 12 and the paper output tray 36 (see FIG. 1). These toner containers 23 are arranged in a sequence of magenta toner container, cyan toner container, yellow toner container, and black toner container from the rear surface side of the printer 1 to the front surface side thereof, and the volume of the black toner container is the largest.

A secondary transfer roller 31 is provided in the secondary transfer section 30, and the secondary transfer roller 31 is constructed so as to be able to press against the intermediate transfer belt 12 from a diagonally downward position.

The intermediate transfer belt 12 and the secondary transfer roller 31 form a nip portion that transfers a toner image composed of toner supplied from the four toner containers 23 onto copy paper.

A fixing section 32, a discharge branch portion 34, and a paper output tray 36 are placed in this sequence on the downstream side of the secondary transfer section 30 in the copy paper feed direction.

In the present example, a duplex unit (feed path) 38 is formed between the secondary transfer section 30 and a manual feed tray 3. This duplex unit (feed path) 38 branches from the discharge branch portion 34 on the front surface side of the apparatus main body 2 so as to extend downwards, and is connected to the upstream side of the register rollers 14.

Here, minute amounts of external additives (titanium oxide, silica, alumina, and the like) are added to the toner of the present example. As is shown in FIG. 2, the aforementioned cleaning portion 50 is provided with a housing 51 that is open towards the photosensitive drum 18 on the downstream side, when viewed in the rotation direction of the photosensitive drum 18, of the transfer position between the photosensitive drum 18 and the intermediate transfer roller (i.e., a (primary transfer roller)) 13. A cleaning blade 52 and a toner recovery portion 80 are provided at suitable positions in this housing 51.

Specifically, the cleaning blade 52 is formed by a main body which is formed from a zinc-coated steel sheet and is fixed to a bottom end of the housing 51, and a blade portion which is made from polyurethane rubber and is welded to this main body. An edge of this blade portion extends in the direction of the axis of rotation of the photosensitive drum 18. In addition, the edge makes contact in a counter direction with the photosensitive drum 18 at a lower position than the rotation axis of the photosensitive drum 18, and scrapes off discharge product materials and residual toner and the like including external additives which have become adhered to the surface of the photosensitive drum 18.

Residual toner and the like which has been scraped off the surface of the photosensitive drum 18 by this cleaning blade 52 is recovered from the toner recovery portion 80.

Specifically, the toner recovery portion 80 has a screw 88 adjacent to a bottom surface of the housing 51. This screw 88 is placed on the right side of the cleaning blade 52 in FIG. 2, and extends in the direction of the rotation axis of the photosensitive drum 18. A distal end of the screw 88 is connected to a drive motor (not shown). When this drive motor is driven, the residual toner and the like inside the housing 51 is collected via the screw 88 in a recovery vessel.

The eraser 19 is located on the downstream side of the cleaning portion 50 and on the upstream side of the charging unit 20 when viewed in the rotation direction of the photosensitive drum 18. After a transfer has been completed and a cleaning step has been performed by the cleaning portion 50, a static elimination light from the eraser 19 is irradiated onto the surface of the photosensitive drum 18, and any charge (i.e., residual charge) remaining on the surface of the photosensitive drum 18 is removed for the next charging.

When the printer 1 is printing, copy paper is separated from the paper feed cassette 4 one sheet at a time by the paper feed rollers 46 and is fed forward. The fed copy paper then arrives at the register rollers 14. The register rollers 14 send the copy paper at a predetermined paper feed timing to the secondary transfer section 30 while calibrating the diagonal feeding of the copy paper and measuring the image transfer timing of the toner image formed in the image formation section 16.

A controller (not shown) is constructed such that it is able to receive the image data which is the sources for printing from external section. This image data may be various types of images such as characters, symbols, diagrams, marks, line drawings, patterns and the like in data form. In addition, the irradiation of light and the like is controlled by this controller based on this data.

Specifically, LED chips 62 and 64 of the eraser 19 are turned on so as to eliminate static from the respective photosensitive drums 18 with being set the intensity of the amount of light to higher or lower in accordance with internal or external irradiation areas of the paper feed width, and the charging unit 20 then charges the surfaces of the respective photosensitive drums 18. Next, when the exposure section 15 irradiates laser light onto the respective surfaces of the photosensitive drums 18, electrostatic latent images are created on the surface of each photosensitive drum 18. Toner images in each color are then formed from these electrostatic latent images by the application of developing bias voltage.

The respective toner images are superimposed onto the intermediate transfer belt 12 (a primary transfer), and then undergo a secondary transfer onto the copy paper in the secondary transfer section 30. Note that any toner remaining on the surface of the photosensitive drums 18 is removed by the cleaning portions 50.

Next, the copy paper is fed towards the fixing section 32 while it is supporting the unfixed toner images and then heated and pressed in the fixing section 32 resulting in the toner images being fixed. Thereafter, the copy paper which has been fed from the fixing section 32 is discharged via the discharging rollers 35 to the paper output tray 36, and is stacked in a height direction.

If double-sided printing is to be performed on this single-side printed sheet, the conveying direction of the copy paper which has been discharged from the fixing section 32 is switched by the discharge branch portion 34. Namely, a sheet of copy paper which has been printed on one side is taken back into the apparatus main body 2, and is then conveyed to a double-side printing unit (conveying path) 38. Next, this copy paper is conveyed towards the upstream side of the register rollers 14, and is then once again fed towards the secondary transfer section 30. As a result of this, a toner image is transferred onto the surface of the copy paper which has not yet been printed on.

Note that, in the image formation unit 17 of the present example, if their respective rotation axes were to be arranged in parallel, it would be found that the respective widths of the developing roller 25, the charging roller 21, and the photosensitive drums 18 and the like are not same.

Figure 3:
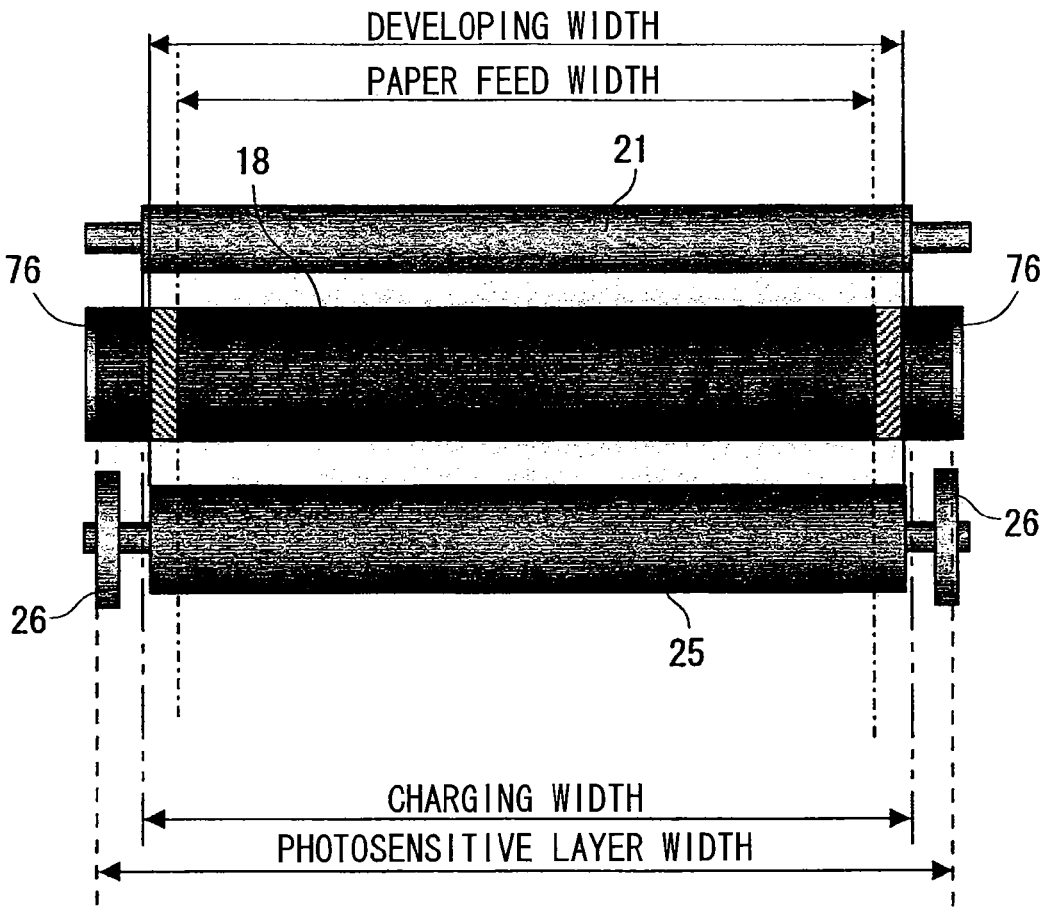
FIG. 3 is an explanatory view showing the widths of the photosensitive drum, charging roller, and developing roller shown in FIG. 2.

Specifically, as is shown in FIG. 3 where the relationships between the widths of the respective structures are illustrated, the width of the photosensitive layer of the photosensitive drum 18 shown by the broken line in FIG. 3 is set wider than the charging width shown by the double-dot chain line in the same drawing. Note that the width of the above described transfer belt 12 is either set between the photosensitive layer width and the charging width, or is set to be equal to the charging width.

Moreover, this charging width is set either wider than or equal to the developing width shown by the solid line in FIG. 3. This is because if the charging width is narrower than the developing width, toner is continuously adhered to the outer side areas of this charging width.

Furthermore, this developing width is always set wider than the paper feed width shown by the single-dot chain line in FIG. 3. This is to make it possible for a toner image to also be formed at both the left and right ends of the copy paper.

Namely, on the surface of the photosensitive drum 18, because in the areas on the outer side of the paper feed width when viewed in the direction of the rotation axis of this photosensitive drum 18, the transfer surface of the transfer belt 12 do not come into contact with the copy paper, these areas form a range where no image is formed.

However, by applying a developing bias voltage, toner which includes external additives also travels towards areas which are on the outer side of the paper feed width as shown by the single-dot chain line in FIG. 3, and are on the inner side of the developing width as shown by the solid lines in FIG. 3, in other words, towards non-image areas 76 which are shown by the diagonal lines in FIG. 3.

This toner does not itself adhere to the surface of the photosensitive drum 18, but returns to the developer 24. This is because the non-image areas 76 correspond to the areas on the inner side of the charging width shown by the double-dot chain line in FIG. 3.

On the other hand, the external additives themselves separate from the toner and remain on the non-image areas 76. Thereafter, if only these external additives are transferred from the surface of the photosensitive drum 18 onto the transfer surface of the belt 12, the non-image areas 76 of the photosensitive drum 18 making the subsequent contact are abraded by the external additives.

Moreover, these non-image areas 76 are formed on all of the photosensitive drums 18, namely, those for magenta, cyan, yellow, and black.

Therefore, in the present example, the amount of static elimination light for these non-image areas 76 is less compared to the amount of static elimination light for the areas on the inner side of the paper feed width which are shown by the single-dot chain line in FIG. 3.

Specifically, as is shown in FIG. 2, the eraser (i.e., the static elimination unit) 19 of the present example performs static elimination after cleaning. Namely, after the cleaning step performed by the cleaning portion 50 via the current transfer, the eraser 19 irradiates static elimination light onto the surface of the photosensitive drum 18 so as to remove any charge (i.e., residual charge) remaining on the surface of the photosensitive drum 18 before the next charging.

Figure 4:
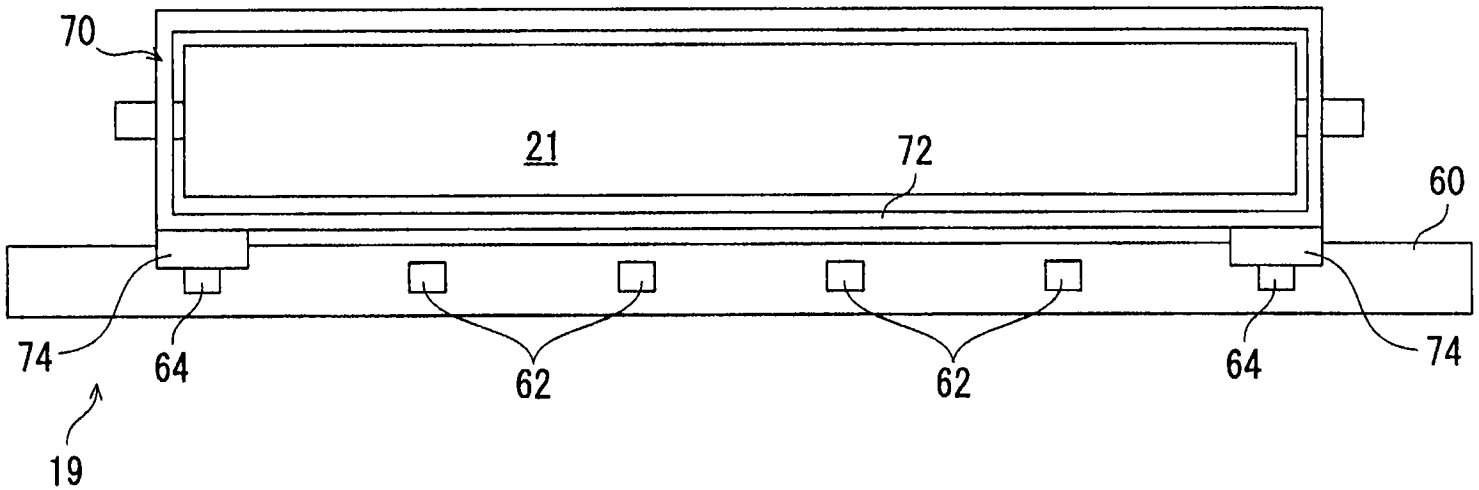
FIG. 4 is a plan view of the eraser shown in FIG. 2.

Moreover, in addition to FIG. 2, as is shown in FIG. 4 which shows a view from the direction of the rotation axis of the photosensitive drum 18, the eraser 19 has a holder 60 which extends along the rotation axis of this photosensitive drum 18, and LED chips (i.e., light sources) 62 and 64 which are embedded in the holder 60 along the longitudinal direction thereof.

The LED chips 62 are located in the holder 60 so as to irradiate areas of the photosensitive drum 18 located on the inner side of the paper feed width. The LED chips 64 are located at both end sides, and are responsible for irradiating the non-image areas 76 as well as boundary portions between the inner sides and outer sides of the paper feed width.

However, the LED chips 62 and 64 of the present example both have substantially equal light emission characteristics (for example, an amount of the light and/or an intensity of the light). This is because the amount of light from the LED chips 64 of the present example is lessened as it travels to the non-image areas 76 and the boundary portions.

More specifically, as is shown in FIGS. 2 and 4, the side wall 72 of the casing 70 of the charging unit 20 which is located on the eraser 19 side performs the function of blocking the static elimination light from the LED chips 62 and 64 from reaching the charging areas, and a light shielding member (i.e., a static elimination intensity adjustment device) 74 is also provided extending upright from this side wall 72.

This light shielding member 74 is mounted on the side wall 72 so as to cover a portion of the LED chips 64 as seen from the photosensitive drum 18. As a result of this, the amount of light from the LED chips 64 irradiated onto the non-image areas 76 and the boundary portions is less compared to the amount of light from the LED chips 62 irradiated onto the inner side areas of the paper feed width.

It should be noted that in the above described example, the amount of light from the LED chips 64 is made less by using the light shielding member 74, however, the structure which is used to lessen the amount of light arriving at the non-image areas 76 and the like is not limited to the light shielding member 74.

Figure 5A:
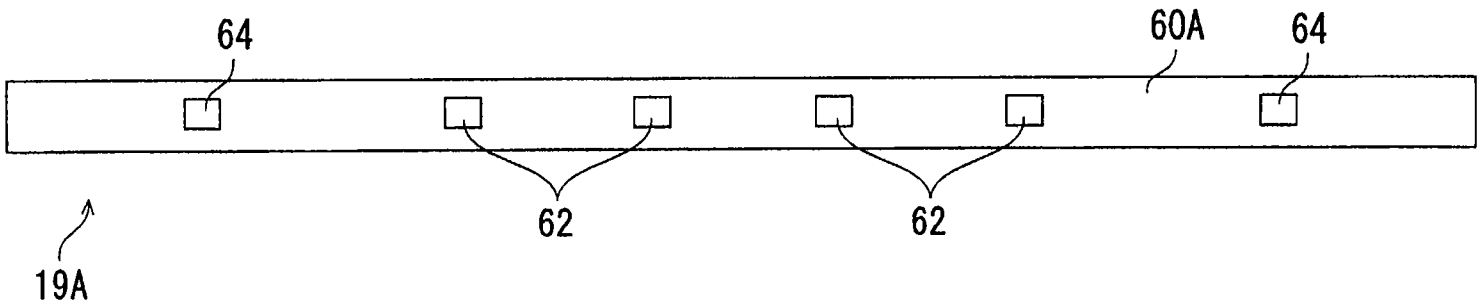
FIG. 5 (*a*) is a plan view showing an eraser of a second example, while FIG. 5 (*b*) is a plan view showing an eraser of a third example.
Figure 5B:
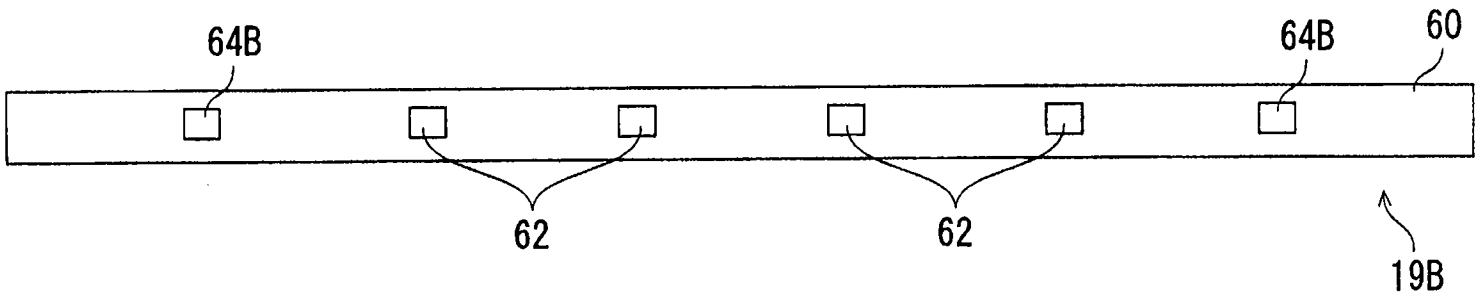

Specifically, in an eraser (static elimination unit) 19A shown in FIG. 5 (*a*) as well, in the same way as in the above described example, using the LED chips 62 and 64 which all have substantially the same light emission characteristics, the LED chips 62 irradiate the areas on the inner side of the paper feed width, while the LED chips 64 irradiate the non-image areas 76 and the aforementioned boundary portions.

However, in the eraser 19A shown in FIG. 5 (*a*), a holder (a static elimination intensity adjustment device) 60A enlarges (widens) the intervals between the LED chips 64 and their adjacent LED chips 62 compared to the intervals between the other LED chips 62 and 62. In this case as well, the amount of light irradiated onto the non-image areas 76 and the boundary portions by these LED chips 64 is less compared to the amount of light irradiated onto the areas on the inner side of the paper feed width by the LED chips 62.

In contrast, in an eraser (static elimination unit) 19B shown in FIG. 5 (*b*), LED chips 62 and LED chips (static elimination intensity adjustment devices) 64B are embedded substantially equidistantly in the holder 60, with the LED chips 62 irradiating the areas on the inner side of the paper feed width, and the LED chips 64B irradiating the non-image areas 76 and the aforementioned boundary portions. However, the chips selected for the LED chips 64B belong to a lesser light quantity ranking than the LED chips 62.

Accordingly, in this case as well, the amount of light irradiated onto the non-image areas 76 and the boundary portions by these LED chips 64B is less compared to the amount of light irradiated onto the areas on the inner side of the paper feed width by the LED chips 62.

As has been described above, according to the present example, in a plurality of image formation units 17, a toner image is individually formed on the surface of each photosensitive drum 18 by developing the latent image thereof using the toner of the corresponding color. On the intermediate transfer belt 12, these individual toner images are then superimposed (i.e., undergo a primary transfer) on the transfer surface, and then undergo a secondary transfer onto the copy paper.

The eraser 19 (19A and 19B) respectively irradiates static elimination light onto the surface of the photosensitive drums 18 prior to the next charging, and removes any charge (i.e., residual charge) remaining on the surface of the photosensitive drums after the transfer.

Here, even if a developing bias voltage is applied, the toner in the non-image areas 76 in FIG. 3, namely, in the areas on the outer side of the paper feed width which are also areas on the inner side of the developing width does not itself adhere to the surface of the photosensitive drums 18. In contrast, the external additives themselves separate from the toner and remain on the non-image areas 76, and only these external additives are transferred from the surface of the photosensitive drums 18 onto the transfer surface of the belt 12. This phenomenon can also be ascertained from the fact that a white band appears on the transfer surface extending in the circumferential direction thereof.

The locations that appear as this white band have a higher abrasion capability and the non-image areas 76 of the photosensitive drums 18 are more abraded than the areas on the inner side of the paper feed width.

Therefore, according to the present example, the respective static elimination intensity adjustment devices provided in the eraser 19 (19A and 19B) lessen the amount of static elimination light for the non-image areas 76 of the photosensitive drums 18 compared to the areas on the inner side of the paper feed width which are shown by the single-dot chain line in FIG. 3, and reduce the amount of electrical discharge (i.e., electrical discharge energy) during charging.

Figure 6:
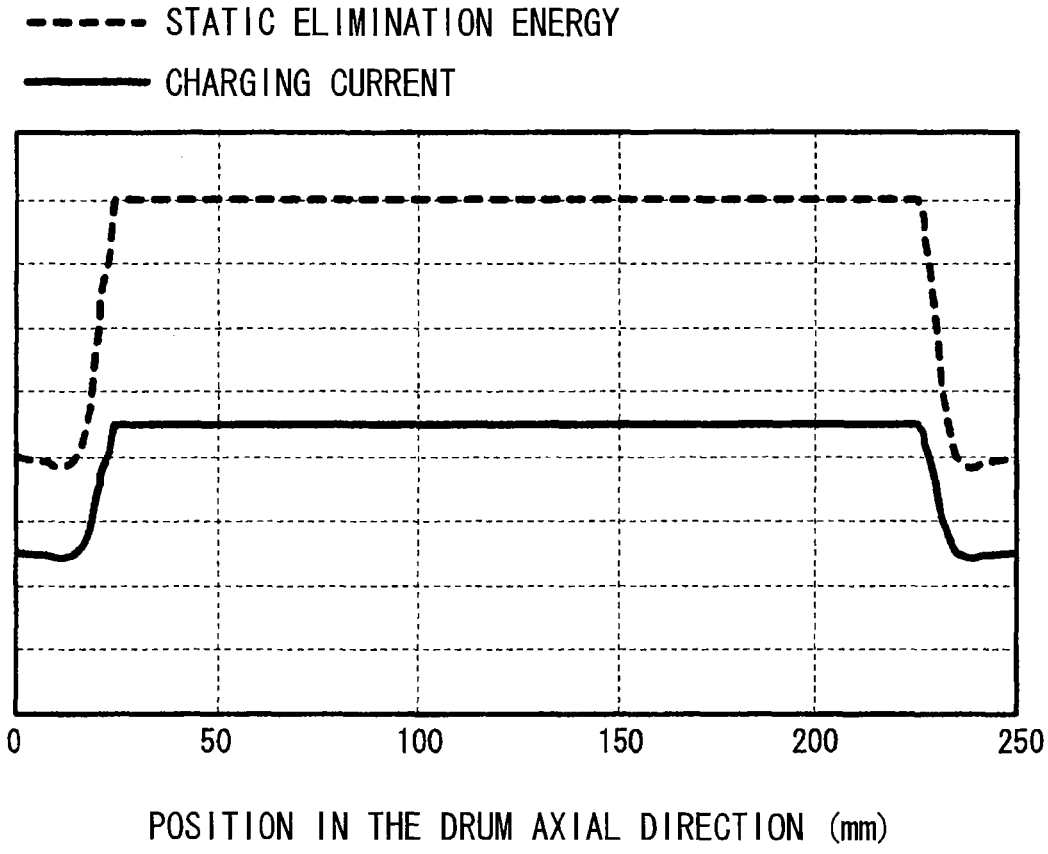
FIG. 6 is a view illustrating a relationship between static elimination energy and charge current.

This point will now be described in further detail. The amount of static elimination light irradiated onto the non-image areas 76 is lessened relative to the amount of static elimination light irradiated onto the areas on the inner side of the paper feed width so that, as is shown by the broken line in FIG. 6, there is a reduction in the static elimination energy (the amount of static elimination light) which corresponds to the non-image areas 76 between 0 mm and approximately 25 mm and also between approximately 225 mm and approximately 250 mm when viewed in the direction of the rotation axis of the photosensitive drums 18. As a result of this, the surface potential in the non-image areas 76 is higher than the surface potential in the areas on the inner side of the paper feed width.

Namely, in the non-image areas 76 there is a decrease in the current flowing from the charging unit 20 to the photosensitive drums 18 when the surface potential is being raised to the level required for the next image formation, and the amount of electrical discharge (i.e., the electrical discharge energy) during charging can be less than that of the areas on the inner side of the paper feed width. In other words, in locations where the static elimination energy has been reduced, as is shown by the solid line in FIG. 6, the surface potential of the photosensitive drums 18 can be saturated by a small charging current.

Accordingly, as a result of any deterioration in the surface of the photosensitive drums 18 which is caused by this electrical discharge energy being suppressed, it becomes difficult for the surface of the photosensitive drums 18 to become abraded by external additives, and it is possible to achieve a lengthening of the lifespan of the photosensitive drums 18.

Figure 7:
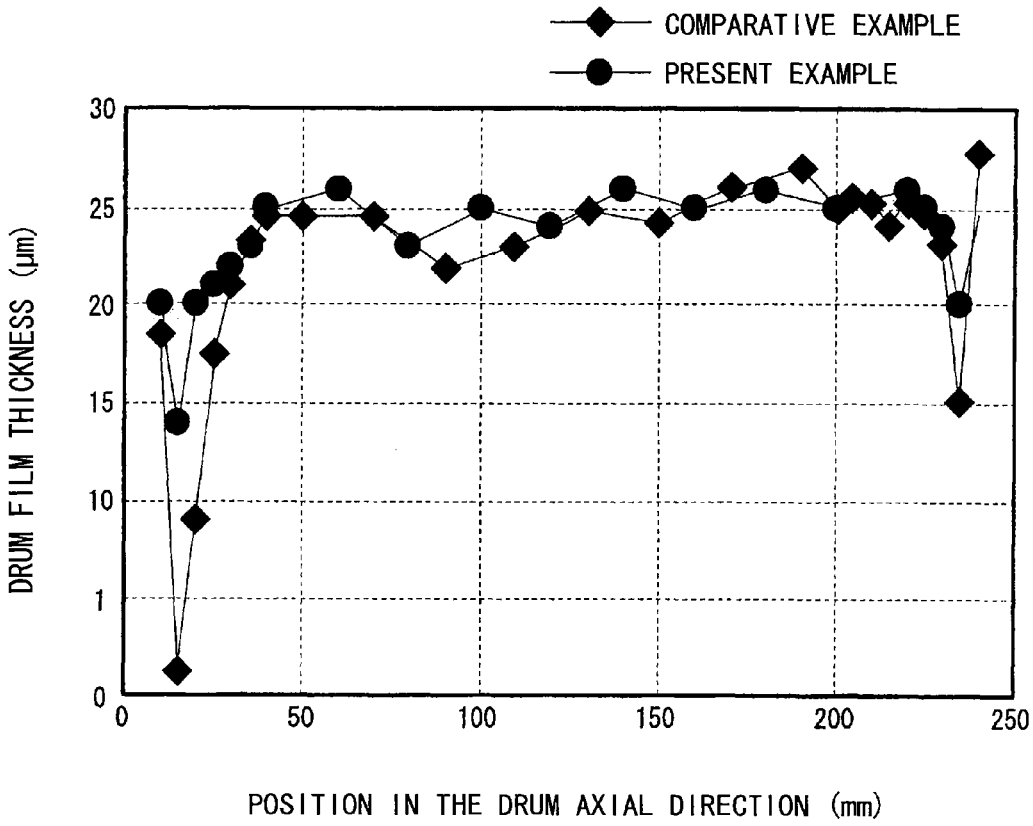
FIG. 7 is an explanatory view showing experiment results.

More specifically, in a comparative example in which the amount of static elimination light irradiated onto the non-image areas 76 is not lessened compared to the areas on the inner side of the paper feed width, but is instead kept substantially the same, as is shown by the "□" symbols (filled lozenge symbols) in FIG. 7, the locations that correspond to the non-image areas 76 are abraded (scraped/scratched/whittled) to a huge extent.

In contrast to this, if, using the eraser 19 (19A and 19B), the amount of static elimination light irradiated onto the non-image areas 76 is less than that onto the areas on the inner side of the paper feed width, then as is shown by the "●" symbols (filled circle symbols) in FIG. 7, it is possible to suppress the amount of wear (abrasion/attrition/detrition) in locations corresponding to the non-image areas 76, and it is possible to secure a photosensitive film thickness which enables the pressure resistance of the photosensitive drums 18 to be maintained. As a result of this, superior image formation can be performed over an extended period, and the reliability of the printer 1 can be improved.

Next, the respective static elimination intensity adjustment devices provided in the eraser 19 (19A and 19B) do not irradiate no static elimination light onto the non-image areas 76 of the photosensitive drums 18, but instead irradiate a less amount of light compared with the amount of light irradiated onto the areas on the inner side of the paper feed width. Accordingly, the amount of light required for the areas on the inner side of the paper feed width can be kept constant, and there is no deterioration in the image quality.

Moreover, if no static elimination light is irradiated, there is a concern that opposite charged toner will be developed, however, as is described above, because the irradiation is performed with the amount of light being kept low, the surface potential in the relevant areas does not become excessively high and it is possible to prevent internal contamination by developing an opposite charged toner.

Furthermore, because the locations where the amount of static elimination light is lessened are the areas on the outer side of the paper feed width, there is no concern of memory image occurring.

Furthermore, because the contact-charging type charging unit 20 does not generate ozone or nitrogen oxides compared to when a corona discharge type charging unit is used, it is possible to obtain an improvement in image quality, but voltage is also applied to the non-image areas 76 of the photosensitive drums 18 with which the charging roller 21 comes into direct contact.

Namely, in the non-image areas 76, because it is unable to withstand the voltage, leaks are generated that penetrate the photosensitive film, and current escapes in an outward direction so that center portions of the surface of the photosensitive drums 18 are not charged, and image abnormalities such as horizontal black stripes tend to occur. However, if the above described static elimination intensity adjustment devices are provided, the aforementioned leaks can be avoided even if the contact-charging type charging unit 20 is used.

Moreover, the surface of an OPC drum 18 is particularly easy to abraded, and there is a concern that abrasion by an external additive will have a considerable influence on this OPC drum 18, however, if the above described static elimination intensity adjustment devices are provided, the characteristics of this OPC drum 18 can be maintained over an extended period and particularly remarkable effects are demonstrated.

Furthermore, as is shown in the examples in FIG. 2 and FIG. 4, the light shielding member 74 lessens the amount of static elimination light reaching the non-image areas 76 of the photosensitive drums 18 thereby shielding, and making it possible to reliably reduce the generation of electrical discharge energy.

Furthermore, as in the example shown in FIG. 5 (*a*), the intervals between the LEDs 64 which are responsible for the non-image areas 76 of the photosensitive drums 18 are wider than the intervals between the LEDs 62, and the number of LED per unit area for the photosensitive drums 18 is reduced so that the amount of static elimination light reaching the non-image areas 76 is lessened. In this case as well, it is possible to reliably reduce the generation of electrical discharge energy.

Moreover, as in the example shown in FIG. 5 (*b*), the light emission characteristics of the LED 64B which are responsible for the non-image areas 76 are reduced to less than the light emission characteristics of the LED 62 so that, even if they are given with the same current, the amount of light is low and the amount of static elimination light reaching the non-image areas 76 is lessened. In this case as well, it is possible to reliably reduce the generation of electrical discharge energy.

Next, another embodiment will be described. In the below description, constituent parts that are identical or equivalent to those in each of the foregoing embodiments are assigned identical symbols, and description thereof is abbreviated or omitted It should be noted that in the image formation unit 17 of the present example, if their respective axes of rotation were lined up, the respective widths of the developing roller 25, the charging roller 21, and the photosensitive drums 18 and the like would not be the same.

Figure 8:
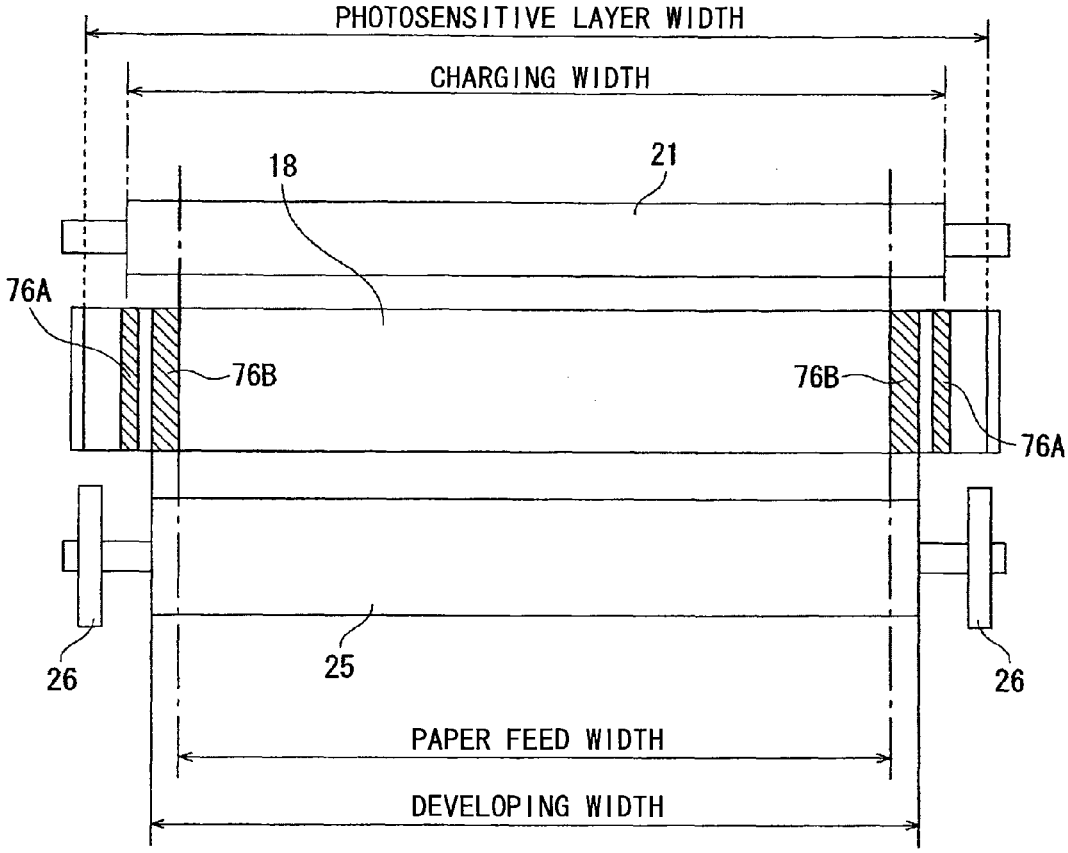
FIG. 8 is an explanatory view showing the widths of the photosensitive drum, charging roller, and developing roller shown in FIG. 2 in another example.

In FIG. 8, a length relation among the developing width, the charging width, the photosensitive layer width (the drum width) and the paper feed width is the same as in FIG. 3.

In addition, the areas on the outer side of the developing width (shown by the solid line in FIG. 8) which are also on the inner side of the charging width (shown by the double-dot chain line in FIG. 8) face the end portions of the charging roller 21, and the current flowing from the charging roller 21 to the surface of the photosensitive drums 18 is increased compared with the areas on the inner side of the paper feed width.

In particular, the pressing force from the charging roller 21 tends to become concentrated in those portions of the photosensitive drums 18 located in the vicinity of the edges of the charging roller 21, in other words, adjacent to the boundary portions of the charging width as shown by the double-dot chain line in FIG. 8. In contrast, in portions of the charging roller 21 facing areas somewhat on the inner side of these, in other words, facing the areas 76A shown by the diagonal lines in FIG. 8, distortion separating away from the surface of the photosensitive drum 18 is generated, and as a result of this concentration of stress and distortion, an excessive electrical discharge phenomenon is easily generated in the areas 76A of the photosensitive drums 18.

Furthermore, a toner which includes external additives is caused by the application of a developing bias voltage to also move towards inner side portions of the areas 76A, namely, towards the vicinity of inner side areas 76B of the developing width shown by the solid line in FIG. 8 which are also the outer side areas of the paper feed width shown by the single-dot chain line in FIG. 8.

This toner does not itself adhere to the surface of the photosensitive drums 18 but returns to the developer 24. This is because the areas 76B correspond to the areas on the inner side of the charging width.

In contrast, the external additives themselves separate from the toner and remain in the areas 76B. Thereafter, if only these external additives are transferred from the photosensitive drums 18 onto the transfer surface of the transfer belt 12, the areas 76B of the photosensitive drums 18 which make the subsequent contact become abraded by the external additives. In addition, these areas 76B are formed on all of the photosensitive drums 18, namely, those for magenta, cyan, yellow, and black.

Therefore, in the present example, this is dealt with by altering the shape of end portions of the charging roller 21, and by adjusting the amount of static elimination light from the eraser 19.

Firstly, the end portions of the charging roller 21, namely, those portions thereof that correspond to the areas on the outer side of the developing width become gradually narrower in diameter as they move away from the areas on the inner side of the paper feed width.

Figure 9:
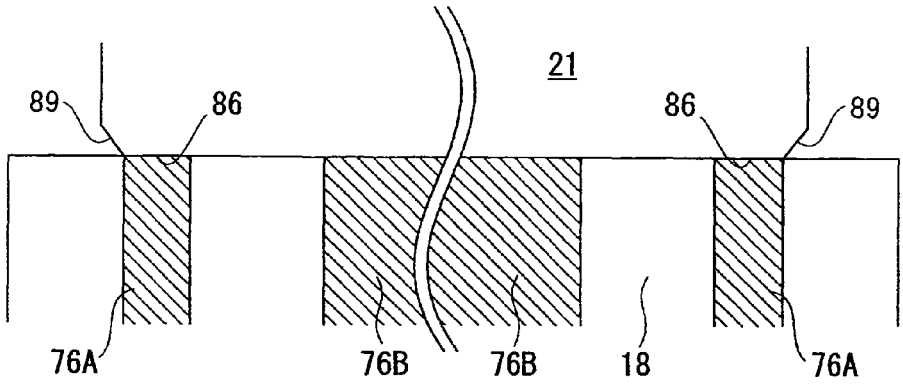
FIG. 9 is an expanded view showing end portions of the charging roller shown in FIG. 8.

More specifically, as is shown in FIG. 9 which is an enlargement of a portion of FIG. 8, the charging roller 21 of the present example has contact end portions 86 that are in contact with the photosensitive drum 18, and contracted diameter end portions 89 which have a narrow outer diameter and whose distance from the photosensitive drum 18 gradually increases.

Of these end portions of the charging roller 21, the former, namely, the contact end portions 86 face the areas 76A, and are continuous with the latter, namely, with the contracted diameter end portions 89. In addition, these contracted diameter end portions 89 are abraded diagonally at edge portions thereof to have a shape which retracts from the surface of the photosensitive drum 18 towards the rotation axis of the charging roller 21; for example, like a C-chamfer. Accordingly, when the charging roller 21 is not pressing against the photosensitive drum 18, it is not in contact with the surface of the photosensitive drum 18 and, furthermore, even when it is pressing against the photosensitive drum 18, it is difficult to make contact with the surface of the photosensitive drum 18.

Next, the amount of static elimination light from the eraser 19 is adjusted with the amount of static elimination light irradiated onto the areas on the outer side of the paper feed width, as is shown by the single-dot chain line in FIG. 8, being reduced compared with the areas on the inner side of this paper feed width.

Specifically, in addition to FIG. 2, as is shown in FIG. 4 which is viewed from the rotation axis of the photosensitive drums 18, the eraser 19 of the present example has a holder 60 which extends along the rotation axis of this photosensitive drum 18, and LED chips 62 and 64 which are embedded in the holder 60 along the longitudinal direction thereof.

The LED chips 62 are located in the holder 60 so as to irradiate inner side areas of the paper feed width of the photosensitive drums 18. The LED chips 64 are located at both end sides, and are responsible for irradiating the areas 76A and 76B.

However, the LED chips 62 and 64 of the present example both have substantially equal light emission characteristics. This is because the amount of light from the LED chips 64 of the present example is lessened as it travels to the areas 76A and 76B.

More specifically, as is shown in FIGS. 2 and 4, the side wall 72 of the casing 70 of the charging unit 20 which is located on the eraser 19 side performs the function of blocking the static elimination light from the LED chips 62 and 64 from reaching the charging areas, and a light shielding member 74 is also provided extending upright from this side wall 72.

This light shielding member 74 is mounted on the side wall 72 so as to cover a portion of the LED chips 64 as seen from the photosensitive drum 18. As a result of this, the amount of light from the LED chips 64 irradiated onto the areas 76A and 76B is less compared to the amount of light from the LED chips 62 irradiated onto the areas on the inner side of the paper feed width.

It should be noted that in the above described example, the amount of light from the LED chips 64 is lessened using the light shielding member 74, however, the structure which is used to lessen the amount of light arriving at the areas 76A and 76B is not limited to this light shielding member 74.

Specifically, in an eraser 19A shown in FIG. 5 (*a*) as well, in the same way as in the above described example, using the LED chips 62 and 64 which all have substantially the same light emission characteristics, the LED chips 62 irradiate the inner side areas of the paper feed width, while the LED chips 64 irradiate the areas 76A and 76B.

However, in the eraser 19A shown in FIG. 5 (*a*), the holder 60A enlarges the intervals between the LED chips 64 and their adjacent LED chips 62 compared to the intervals between the other LED chips 62 and 62. In this case as well, the amount of light irradiated onto the areas 76A and 76B by these LED chips 64 is less compared to the amount of light irradiated onto the areas on the inner side of the paper feed width by the LED chips 62.

In contrast, in the eraser 19B shown in FIG. 5 (*b*), LED chips 62 and LED chips 64B are embedded substantially equidistantly in the holder 60, and the LED chips 62 are responsible for the areas on the inner side of the paper feed width, and the LED chips 64B are responsible for the areas 76A and 76B. However, the chips selected for the LED chips 64B belong to a smaller light quantity ranking than the LED chips 62. Accordingly, in this case as well, the amount of light irradiated onto the areas 76A and 76B by these LED chips 64B is less compared to the amount of light irradiated onto the areas on the inner side of the paper feed width by the LED chips 62.

As has been described above, according to the present example, a toner image is formed on the surface of the photosensitive drums 18 by developing a latent image thereof using toner by driving the photosensitive drums 18 to rotate, and this toner image is then transferred onto the intermediate transfer belt 12.

In the contact-charging type charging unit 20, because the charging roller 21 presses and charges the surface of the photosensitive drums 18, so that it does not generate ozone or nitrogen oxides compared to when a corona discharge type charging unit is used, it is possible to obtain an improvement in image quality. Moreover, the eraser 19 (19A and 19B) irradiates static elimination light onto the surface of the photosensitive drums 18 prior to charging, and removes any charge (i.e., residual charge) remaining on the surface of the photosensitive drums after the transfer.

Here, in the charging roller 21, areas on the outer side of the developing width as viewed from the direction of the rotation axis of the photosensitive drums 18 are shaped such that the diameter thereof gradually contracts as it moves away from the paper feed width. Accordingly, the stress concentration in edge portions of a conventional charging roller, as well as the distortion on the inner side of these edge portions which is generated from this stress concentration are alleviated.

As a result of this, in end portions of a charging roller, any excessive current flowing into the photosensitive drums is decreased, and it is possible to suppress any deterioration in the surface of the photosensitive drums 18 which is caused by the amount of electrical discharge (i.e., electrical discharge energy) during charging.

At the same time, in the eraser 19 (19A and 19B), because the amount of static elimination light irradiated onto the areas of the surface of the photosensitive drums 18 which are located on the outer side of the paper feed width is less compared to the amount of static elimination light irradiated onto the areas on the inner side of this paper feed width, in the areas on the outer side of the paper feed width only a small amount of current flowing from the charging unit to the photosensitive drums 18 is needed when the surface potential is being raised to the level required for the next image formation. Because of this, any deterioration in the surface of the photosensitive drums 18 which is caused by the generation of this electrical discharge energy is inhibited.

Moreover, when the toner contains external additives, as in the present example, if there is any advance in the deterioration of the surface of the photosensitive drums 18, then the surfaces of the photosensitive drums 18 are easily abraded by the transfer belt 12 and the cleaning blade 52, and there is a concern that the amount of this abrasion will particularly shorten the lifespan of the photosensitive drums 18. However, as in the present example, if the above described modification to the shape of the charging roller 21 is combined with the control of the amount of light from the eraser 19 (19A and 19B), then it becomes possible to not only suppress the aforementioned abrasion of the photosensitive drums 18 which accompanies the generation of electrical discharge energy, but also suppress an abrasion of the surface of the photosensitive drum 18 which is caused by polishing from the external additives.

These points will now be described more specifically.

As a comparative example, if the shape of the charging roller 21 is formed in a simple circular-cylinder shape with vertically upright edges, the pressing force from the charging roller 21 onto the surface of the photosensitive drum 18 is concentrated in edge portions 108 (see FIG. 10) of the charging roller 21, and distorted portions 106 are generated somewhat on the inner side of these edge portions 108 to separate from the surface of the photosensitive drum 18.

Figure 11:
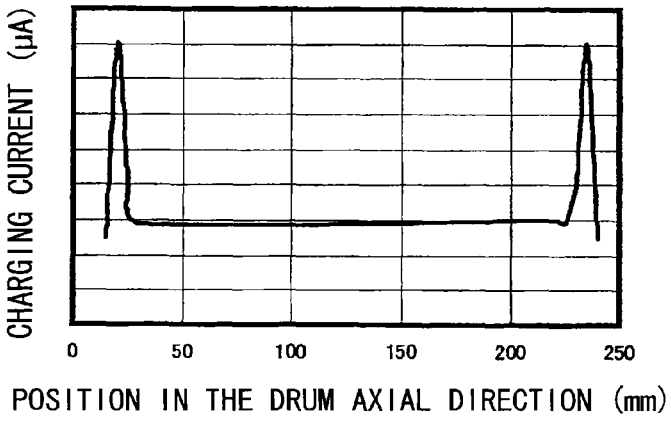
FIG. 11 is a view illustrating the charge current distribution in the photosensitive drum axial direction for the comparative example shown in FIG. 10.

In addition, as is shown in FIG. 11, this causes an extreme rise in the flow current from the edge portions 108 to the surface of the photosensitive drum 18, and in the distorted portions 106 which are located somewhat on the inner side of the edge portion 108, an excessive electrical discharge phenomenon occurs, so that there is a marked acceleration in the deterioration of the surface of the photosensitive drum 18 which is caused by the electrical discharge energy.

Figure 10:
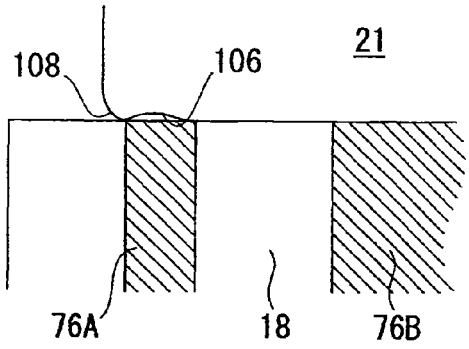
FIG. 10 is an expanded view showing end portions of a charging roller of a comparative example.
Figure 14:
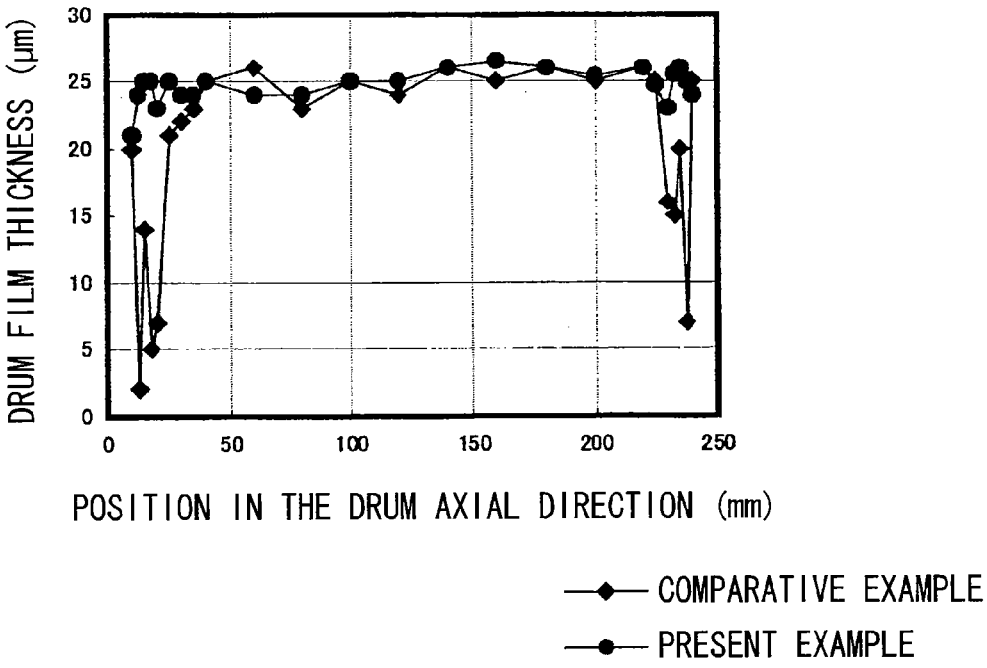
FIG. 14 is an explanatory view showing results of a durability experiment.

Namely, in the comparative example shown in FIG. 10, as is shown by the "□" symbols (filled lozenge symbols) in FIG. 14, because the locations that correspond to the areas 76A are abraded to a huge extent, in the areas 76A, because it is unable to withstand the voltage, leaks are generated that penetrate the photosensitive film, and current escapes in an outward direction so that center portions of the surface of the photosensitive drums 18 are not charged, and image abnormalities such as horizontal black stripes tend to occur.

In contrast to this, in the present example, firstly, end portions of the charging roller 21 that correspond to the areas on the outer side of the developing width have the contact end portions 86 that are in contact with the areas 76A, however, the contracted diameter end portions 89 are provided on the outer side of the areas 76A, and when the charging roller 21 presses against the photosensitive drum 18, although these contracted diameter end portions 89 are widened by this pressing force in the direction of the surface of the photosensitive drum 18, they do not come into contact with the surface of the photosensitive drum 18.

Figure 12:
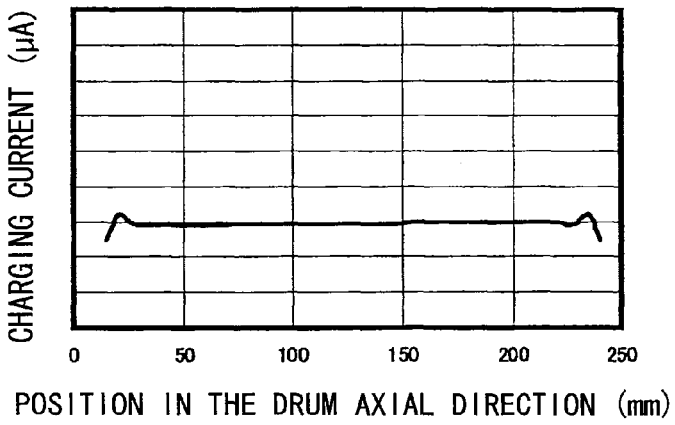
FIG. 12 is a view illustrating the charge current distribution in the photosensitive drum axial direction obtained by altering only the shape of the charging roller shown in FIG. 8.

As a result of this, the contact end portions 86 do not move away from the areas 76A, and because the stress concentration in the edge portions 108, as well as the distorted portions 106 on the inner side of these edges 108 which are caused by the pressing force from a conventional charging roller can be alleviated, in end portions of the charging roller 21, it can be seen that any excessive current flowing into the photosensitive drums 18 is decreased (see FIG. 12), and that it is possible to suppress any deterioration in the surface of the photosensitive drums 18 which is caused by electrical discharge energy.

Moreover, the amount of static elimination light irradiated onto the outer side areas of the paper feed width by the eraser 19 (19A and 19B) is lessened, and so in these outer side areas of the paper feed width there is a reduction in the carriers generated in the photosensitive film of the photosensitive drums 18 so that the charge blocking effect during the charging step is suppressed. Thus, any deterioration in the surface of the photosensitive drums which is caused by the generation of this electrical discharge energy is restricted.

Figure 13:
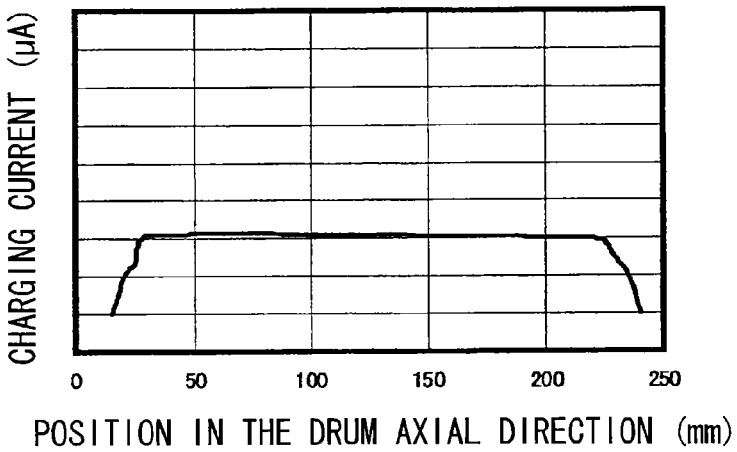
FIG. 13 is a view illustrating the charge current distribution in the photosensitive drum axial direction obtained from the present example.

Namely, if, as in the present example, the above described modification to the shape of the charging roller 21 is combined with the control of the amount of light from the eraser 19 (19A and 19B), then, as is shown in FIG. 13, it becomes possible to greatly reduce any excess current flowing to the photosensitive drums 18.

As a result of this, according to the present example, as is shown by the "●" symbols (filled circle symbols) in FIG. 14, it is possible to suppress the amount of wear in locations that correspond to the areas 76A and 76B, and it is possible to secure a film thickness which enables the pressure resistance of the photosensitive drums 18 to be maintained. As a result of this, superior image formation can be performed over an extended period, and the reliability of the printer 1 can be improved.

Next, the eraser 19 (19A and 19B) does not irradiate no static elimination light onto the areas on the outer side of the paper feed width of the surface of the photosensitive drums 18, but instead irradiates a less amount of light compared with the amount of light irradiated onto the areas on the inner side of the paper feed width. Accordingly, the amount of light required for the areas on the inner side of the paper feed width can be kept constant, and there is no deterioration in the image quality.

Moreover, if no static elimination light is irradiated, there is also a concern that opposite charged toner will be developed, however, as is described above, because the irradiation is performed with the amount of light being kept low, the surface potential in the relevant areas does not become excessively high and it is possible to prevent internal contamination by developing an opposite charged toner. Furthermore, because the locations where the amount of static elimination light is lessened are the areas on the outer side of the paper feed width, there is no concern of memory image occurring.

Furthermore, the surface of the OPC drums 18 are particularly easy to abrade and there is a concern that deterioration due to electrical discharge and abrasion caused by the external additives will have a considerable influence on the OPC drums 18, however, if the above described modification to the shape of the charging roller 21 is combined with the control of the amount of light from the eraser 19 (19A and 19B), then it becomes possible to maintain the characteristics of the OPC drums 18 for an extended period and particularly remarkable effects are demonstrated.

Furthermore, as is shown in the examples in FIG. 2 and FIG. 4, the light shielding member 74 lessens the amount of static elimination light reaching the areas 76A and 76B thereby shielding, and making it possible to reliably reduce the generation of electrical discharge energy.

Furthermore, as in the example shown in FIG. 5 (*a*), the intervals between the LED 64 which are responsible for the areas 76A and 76B are more widened than the intervals between the LED 62, and the number of LED per unit area for the photosensitive drums 18 is reduced so that the amount of static elimination light reaching the areas 76A and 76B is lessened. In this case as well, it is possible to reliably reduce the generation of electrical discharge energy.

Moreover, as in the example shown in FIG. 5 (*b*), the light emission characteristics of the LED 64B which are responsible for the areas 76A and 76B are reduced to less than the light emission characteristics of the LED 62 so that, even if they are provided with the same current, the amount of light is low and the amount of static elimination light reaching the areas 76A and 76B is lessened. In this case as well, it is possible to reliably reduce the generation of electrical discharge energy.

The present invention is not limited to the above described examples and various modifications may be made thereto insofar as they do not depart from the range of the claims.

For example, in the above described examples, toner images are transferred onto the intermediate transfer belt above the photosensitive drums in a direction of gravity, however, the toner images may also be transferred onto the belt below the photosensitive drums.

Moreover, in the above described examples, the description is for the printer 1 which adopts an intermediate transfer belt. However, in other examples, the present invention can also be applied in cases in which a toner image on the photosensitive drums 18 is directly transferred onto copy paper, and the transfer material of the present invention may also be copy paper.

More specifically, describing FIG. 2 as an example, even if in a case in which a direct transfer is performed, toner and external additives in areas on the inner side of the paper feed width are transferred onto copy paper, so it is difficult for them to remain on the surface of the photosensitive drums. Moreover, even if a developing bias voltage is applied, the toner itself in the non-image areas 76 of the photosensitive drums 18 does not adhere to the surface of the photosensitive drums 18. In contrast, the external additives separate from the toner and remain in the non-image areas 76, and only these external additives are accumulated from the surface of the photosensitive drums 18 to the edge of the cleaning blade 52. Note that the width of this cleaning blade 52 is substantially equal to the above described developing width.

This is because the locations where the external additives accumulate have higher abrasion capability, and the non-image areas 76 are abraded to a greater degree than the areas on the inner side of the paper feed width so that the same type of problems arise as when the above described intermediate transfer belt is adopted.

Furthermore, in this example, a printer is described as an example of an image forming apparatus, however, in other examples, naturally, the image forming apparatus can also be applied to multi-function copiers, duplicating machines, facsimiles and the like.

In the case of each of these apparatuses, in the same way as is described above, the effect is demonstrated that it is possible to inhibit wear in areas on the outer side of the paper feed width.

What is claimed is:

1. An image forming apparatus that forms a toner image by using toner which includes external additives to develop a latent image which is formed via charging and exposure on a surface of a photosensitive drum, and that transfers the toner image onto a transfer material, the apparatus comprising:

a static elimination unit that irradiates static elimination light onto the surface of the photosensitive drum before the surface of the photosensitive drum is charged, and removes any charge remaining on the surface of the photosensitive drum after it has completed the transfer; the static elimination unit is provided with a plurality of light sources having substantially the same light emission characteristics and that extend along the rotation axis of the photosensitive drum;

a static elimination intensity adjustment device that, compared with inner side areas of a paper feed width, lessens an amount of the static elimination light irradiated onto areas which, when viewed in a direction of a rotation axis of the photosensitive drum, are on an outer side of a paper feed width and are also on an inner side of a developing width; and in the static elimination intensity adjustment device, an interval between the light sources which is responsible for the areas which are on the outer side of the paper feed width and are also on the inner side of the developing width is longer than that interval of the areas on the inner side of the paper feed width.

2. The image forming apparatus according to claim 1, wherein the static elimination unit irradiates the static elimination light onto areas which are on the outer side of the paper feed width and are also on the inner side of the developing width.

3. The image forming apparatus according to claim 1, further comprising a charging unit that comes into contact with and charges the surface of the photosensitive drum.

4. The image forming apparatus according to claim 1, wherein the photosensitive drum has an organic-based photosensitive layer on the surface thereof.

5. The image forming apparatus according to claim 1, wherein the static elimination intensity adjustment device is a light shielding member that covers the static elimination unit for the areas which are on the outer side of the paper feed width and are also on the inner side of the developing width.

6. An image forming apparatus that forms a toner image by using toner which includes external additives to develop a latent image which is formed via charging and exposure on a surface of a photosensitive drum, and that transfers the toner image onto a transfer material, the apparatus comprising:

a static elimination unit that irradiates static elimination light onto the surface of the photosensitive drum before the surface of the photosensitive drum is charged, and removes any charge remaining on the surface of the photosensitive drum after it has completed the transfer;

the static elimination unit is provided with a plurality of light sources that extend along the rotation axis of the photosensitive drum; and a static elimination intensity adjustment device that, compared with inner side areas of a paper feed width, lessens an amount of static elimination light irradiated onto areas which, when viewed in a direction of a rotation axis of the photosensitive drum, are on an outer side of a paper feed width and are also on an inner side of a developing width; and in the static elimination intensity adjustment device, a light emission characteristic of the light sources which is responsible for the areas which are on the outer side of the paper feed width and are also on the inner side of the developing width is less than that of the areas on the inner side of the paper feed width.

7. An image forming apparatus that forms a toner image by using toner to develop a latent image which is formed via charging and exposure on a surface of a photosensitive drum, and that transfers the toner image onto a transfer material, comprising:

a charging unit having a charging roller that charges the surface of the photosensitive drum by coming into contact with the surface;

a static elimination unit that irradiates static elimination light onto the surface of the photosensitive drum before the charging is performed, and removes any charge remaining on the surface of the photosensitive drum after it has completed the transfer;

the charging roller is shaped such that areas thereof on an outer side of a developing width, when viewed in a direction of a rotation axis of the photosensitive drum, become gradually narrower in diameter further from a paper feed width;

the static elimination unit has a static elimination intensity adjustment device that lessens an amount of static elimination light irradiated onto the areas which are on an outer side of the paper feed width compared with areas which are on the inner side of the paper feed width;

the static elimination unit is provided with a plurality of light sources having substantially the same light emission characteristics and that extend along the rotation axis of the photosensitive drum; and in the static elimination intensity adjustment device, an interval between the light sources which is responsible for the areas which are on the outer side of the paper feed width and are also on the inner side of the developing width is longer than that interval of the areas on the inner side of the paper feed width.

8. The image forming apparatus according to claim 7, wherein the static elimination unit irradiates static elimination light onto the areas on the outer side of the paper feed width.

9. The image forming apparatus according to claim 7, wherein the photosensitive drum is a photosensitive drum having an organic-based photosensitive layer on the surface thereof.

10. The image forming apparatus according to claim 7, wherein the toner image is formed by developing using toner containing external additives.

11. The image forming apparatus according to claim 7, wherein the static elimination intensity adjustment device is a light shielding member that covers the static elimination unit for the areas which are on the outer side of the paper feed width and are also on the inner side of the developing width.

12. An image forming apparatus that forms a toner image by using toner to develop a latent image which is formed via charging and exposure on a surface of a photosensitive drum, and that transfers the toner image onto a transfer material, comprising:

a charging unit having a charging roller that charges the surface of the photosensitive drum by coming into contact with the surface;

a static elimination unit is provided with a plurality of light sources that extend along the rotation axis of the photosensitive drum that irradiate static elimination light onto the surface of the photosensitive drum before the charging is performed, and remove any charge remaining on the surface of the photosensitive drum after it has completed the transfer;

the charging roller is shaped such that areas thereof on an outer side of the developing width, when viewed in a direction of a rotation axis of the photosensitive drum, become gradually narrower in diameter further from a paper feed width;

the static elimination unit has a static elimination intensity adjustment device that lessens the amount of static elimination light irradiated onto the areas which are on an outer side of the paper feed width compared with areas which are on an inner side of the paper feed width; and in the static elimination intensity adjustment device, the light emission characteristic of the light sources which is responsible for the areas which are on an outer side of a paper feed width and are also on an inner side of the developing width is less than that of the areas on the inner side of the paper feed width.

* * * * *